United States Patent [19]

Crisp

[11] Patent Number: 4,515,072

[45] Date of Patent: May 7, 1985

[54] SPRAYBOOTH

[75] Inventor: Eric H. Crisp, Colchester, England

[73] Assignee: Spraybake Limited, England

[21] Appl. No.: 444,094

[22] Filed: Nov. 24, 1982

[30] Foreign Application Priority Data

Dec. 14, 1981 [GB] United Kingdom ..... 8137625

[51] Int. Cl.[3] ..... B05C 15/00

[52] U.S. Cl. ..... 98/115.2; 55/DIG. 46

[58] Field of Search ..... 55/385 A, DIG. 46; 98/33 R, 33 A, 115 R, 115 SB; 118/326, 634, DIG. 7

[56] References Cited

U.S. PATENT DOCUMENTS

| | | | |
|---|---|---|---|
| 1,750,774 | 3/1930 | Fahlstrom | 98/115 SB |
| 3,496,856 | 2/1970 | Wiggins | 98/33 R |
| 4,133,255 | 1/1979 | Guice | 98/115 SB |

FOREIGN PATENT DOCUMENTS

| | | | |
|---|---|---|---|
| 6120 | 1/1980 | European Pat. Off. | 118/326 |
| 2110694 | 9/1972 | Fed. Rep. of Germany | 98/115 SB |
| 118541 | 9/1980 | Japan | 98/33 R |
| 677774 | 8/1979 | U.S.S.R. | 118/DIG. 7 |

*Primary Examiner*—Harold Joyce

*Attorney, Agent, or Firm*—Sughrue, Mion, Zinn, Macpeak and Seas

[57] ABSTRACT

A spraybooth for use, for example, in spray painting motor vehicles has an air supply duct 11 which extends centrally along the length of the top 5 of the booth and has an air supply opening 12 fitted with a cloth filter 16 in its underside. The opening 12 extends from near one end 1 of the booth right up to the outer end 2 and is supplied with air by a fan 9 from the one end of the booth. A single air outlet opening 17 is provided at the middle of the bottom of the one end 1 of the booth and is connected to an air extraction fan 21. The velocity head of the air flow from the air supply fan 9 decreases along the length of the air supply opening 12 from the one end 1 to the other 2 and accordingly the pressure head increases so that the downward air flow from the filter cloth 16 per unit length of the air supply opening decreases from the one end 1 to the other end of the booth 2. This arrangement achieves an extremely efficient downward air flow pattern in the booth with little or no turbulence so that, after spraying, droplets of paint with which the air in the booth is contaminated after spraying are not precipitated on the surface which has been sprayed.

12 Claims, 7 Drawing Figures

1
2
3
5
6
9
10
11
12
13
14
15
16
17
18
19
20
21
22
23
24
25
26
27
28
29
30
IV
IV

SPRAYBOOTH

In spraybooths such as are used, for example, in the spray painting of motor vehicles, it is necessary to provide an air supply and extraction system to supply air to, and remove air from, the booth during and after spraying so that droplets of paint with which the air is contaminated are not precipitated on the surface which has been spray painted. It is usual while painting is proceeding, to supply fresh air to the booth and subsequently, when painting has been completed, to recirculate the air, which is heated and cleaned during its circulation, to expedite drying of the paint.

In order to avoid precipitation of paint droplets suspended in the air before the air is extracted it is essential that there should be an air flow from a supply at the top of the booth to an outlet at the bottom of the booth without any eddies or undue turbulence which tend to bring about precipitation.

To achieve the requisite air flow, it is the general practice to supply air to the booth through a filter from an opening extending along the top of the booth and to withdraw air through a central outlet which extends along the floor of the booth. The rate of air flow through the booth is however very considerable and, for example, is usually more than about 150 $m^3$/min, and to maintain reasonable air flow velocities through outlet ducting, it is necessary for this ducting to have a substantial cross-sectional area of at least 0.5 $m^2$. Accordingly the provision of an outlet extending along the length of the floor of the booth when the floor is at ground level calls for excavation of the ground to install outlet ducting. Alternatively it is necessary to raise the floor of the booth above ground level or above the floor of the factory or workshop in which the booth is situated. If the floor of the booth is raised, an access ramp must be provided to enable the vehicles to be driven into the booth and the expense of the excavation or of the structure involved in the raised floor and access ramp is very considerable.

Various attempts have therefore been made to provide spraybooths with an air supply and extraction system in which an air outlet opening is provided in a side or end wall of the booth near its bottom. None of these systems have been effective in producing the necessary downward air flow which extends along the whole length of the booth and which is free of eddies or turbulence as is necessary to achieve spray painting of high quality.

We have now discovered an arrangement of air supply and outlet openings in a spraybooth which unexpectedly achieves an extremely efficient downward air flow pattern in a very simple manner.

According to this invention, a spraybooth, which is intended, for example, for use in spray painting motor vehicles and which has side and end walls and a top, is provided with an air supply and extraction system comprising air supply duct means which extends substantially centrally along the length of the top and has an air supply opening or openings fitted with filter means for supplying air downwardly, the filter means extending from a position at or adjacent one end of the booth to a position at or adjacent the other end of the booth, one or more air outlet openings in the bottom of one end wall at the one end of the booth, an air extraction fan or pump connected to the air outlet opening or openings and a blower for causing air to flow through the air supply duct means in a direction from the one end to the other end of the booth so that, in use, the velocity head of the air flow decreases and the pressure head of the air increases along the length of the filter means and the downward air flow per unit length of the supply duct means increases in a direction from the one end to the other end of the booth.

The location of the air supply opening or openings and the variation of the air flow from the filter means along its length, together with the location of the air outlet opening or openings, which must be in the bottom of the one end wall of the booth, had been found to be critical in producing the requisite downward air flow, which is substantially free of eddies, throughout the booth.

Pressure tests taken at various points throughout the booth have shown that there is a gradually increasing positive pressure below the filter means from the one end towards the other end of the supply duct. This is produced by the change of the increasing velocity head of the air as it leaves the filter means into pressure head after the air has left the filter means. The tests also show, more suprisingly, that although the air outlet opening or openings are situated only in the one end of the booth, there is a negative, that is sub-atmospheric, pressure along the length of the bottom of the booth. The pressure gradually increases, that is to say gradually approaches atmospheric pressure, from the one end towards the other end of the booth.

It has been found that there is accordingly a substantially constant pressure difference along the whole length of the booth between points just below the filter means and further points directly below the first points and near the bottom of the booth. This, as confirmed by smoke tests, causes the air flow from the filter means along the whole length of filter means to take place directly downwards to a position closely adjacent the bottom of the booth and then to be diverted horizontally along the bottom to the air outlet opening or openings.

This flow pattern, when the booth is empty, is most beneficial and it is suprising that it can be achieved and an air outlet opening or openings in the one end wall of the booth. It would be expected that the air flow from the filter means would take place directly towards the air outlet opening or openings and such a flow would not be at all satisfactory.

What is even more important is that it has been found that when a motor vehicle is present in the booth and is being sprayed with paint or is being dried after it has been sprayed, the beneficial flow pattern is maintained. Along the whole length of the filter means, air flows directly downwards and then flows around the vehicle, that is down the sides or front of the vehicle and then beneath the vehicle along the floor of the booth to the air outlet opening or openings at the one end of the booth.

It is preferred that the filter means should extend along the booth right up to the end of the booth remote from the air outlet opening or openings, as the closer it extends to this end the better the air flow pattern which is achieved. Adequate results can however be obtained with the filter means terminating up to about 10% of the length of the booth from the end remote from the air outlet opening or openings.

The filter means may also extend right up to the end of the booth at which the air outlet opening or openings are provided, but this involves some waste of air. This is because air travels directly down the end of the booth from the end of the filter means to the outlet opening or openings and this flow of air has little, if any, paint contamination. Preferably therefore the filter means terminates at a distance from the one end of the booth and this distance is preferably not more than 20% of the length of the spraybooth from the one end of the booth.

The air supply duct means may be of a conventional cross-section, having, for example, a height equal to half its width. Preferably, however, in order to spread the air distribution further across the width of the booth, the air supply duct means has a height equal to one quarter or less of its width and a single air supply opening preferably extends across substantially the whole of the width of the underside of the duct.

Preferably there is only a single air outlet opening and this is in the middle of the bottom of the one end wall. As an alternative, however, a number of outlet openings may be provided and these are then preferably symmetrically arranged across the width of the end wall of the booth.

To ensure that the air is extracted from the booth as close to its bottom as is practicable, the air outlet opening or openings are preferably provided with louvres or baffles which are downwardly inclined in a direction towards the inside of the booth.

When there is a single air outlet opening in the underside of the air supply duct means, the filter means preferably consists as is conventional, of a panel of filter cloth, which is clamped at its sides and ends and is held taut over the whole extend of the air supply opening.

It has been found that the most satisfactory air flow pattern is obtained if there is only one air outlet opening situated centrally, as already mentioned, and if this opening has a width equal to approximately one quarter of the overall internal width of the booth and a height equal to approximately one quarter of its own width. If there is more than one air outlet opening, it is most desirable that no air outlet opening should be situated in the corners of the end wall or very close to these corners because openings in these positions tend to produce eddies in the corners. The minimum distance between any air outlet opening at a side wall of the booth should be not less than 5% of the width of the spraybooth and preferably substantially more.

In order to achieve the gradually decreasing velocity head and increasing pressure head along the length of the filter means, it is necessary to have a substantially lamina air flow directly along the air supply duct means with a minimum of turbulence. For this purpose it is desirable to have a straight length of duct upstream of the upstream end of the air supply opening or openings. If, however, the air supply opening and the filter means extend right up to the one end of the booth, it is most desirable that the air supply blower should either blow axially straight along the duct means or, if it blows transversely to the length of the duct means, there should be a straight length of duct between the upstream end of the supply opening or openings and the bend by which the blower outlet is connected to the air supply duct means.

In an alternative construction, in place of the air supply duct means of rectangular cross-section with the air supply opening and filter means in its underside, the air supply duct means and the filter means comprise an air supply manifold which is located at or adjacent the one end of the booth and has a number of air supply openings directed towards the other end of the booth and a tube of filter material sealed around and extending from each air supply opening to the position at or adjacent the other end of the booth, the ends of the tubes of filter material remote from the manifold being closed.

Two examples of spraybooths in accordance with the invention are illustrated diagrammatically in the accompanying drawings in which.

Figure 1:
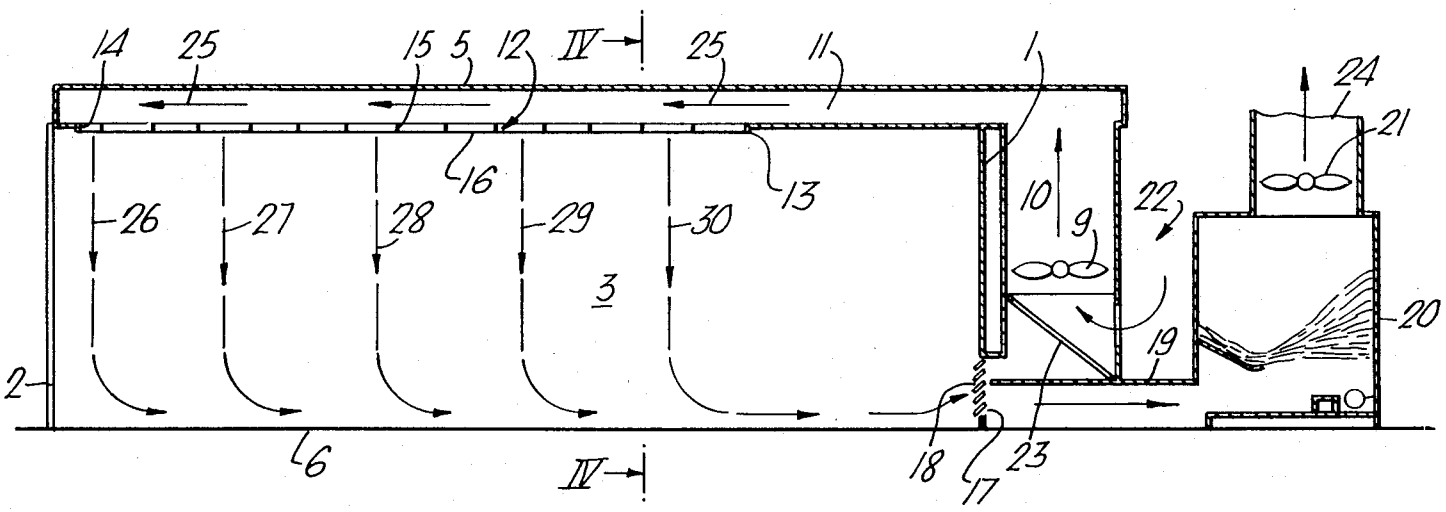
FIG. 1 is a longitudinal section through the first example showing the air flow through the booth which takes place during spray painting of a motor vehicle or other object in the booth.

The example of the spraybooth shown in the FIGS. 1 to 4 has a first end wall 1, a second end wall 2, side walls 3 and 4 and a top 5. The spraybooth is based on a flat level floor 6 upon which the booth merely rests and in which no excavation is necessary. Main access doors 7 are provided in the end wall 2 to enable a motor vehicle to be sprayed to be driven into the booth and additionally there is an operator's door 8 in the side wall 3.

In this example the internal length of the booth is approximately 7 m, its internal width 4.5 m and its internal height 2.5 m.

Figure 4:
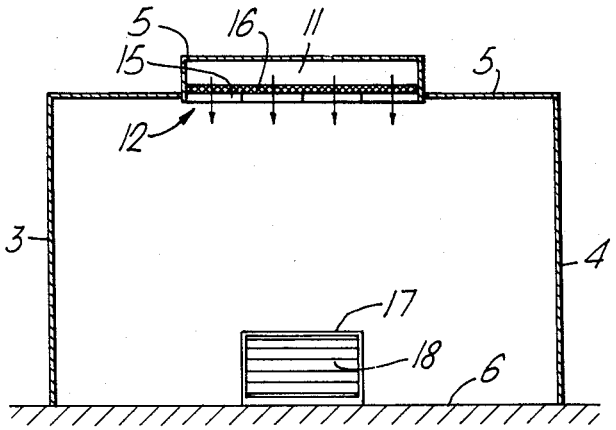
FIG. 4 is a cross-section through the first example as seen in the direction of the arrows on the line IV—IV in FIG. 1.

Air is supplied to the booth by a fan 9 which discharges the air through an air heater 10 into a rectangular air supply duct 11 which, as shown in FIG. 4, extends across a major part of the width of the top 5. The air supply duct 11 has an air supply opening 12 extending across the whole width of the underside of the air supply duct 11 from a position 13 near the first end wall 1 to a position 14 very close to the end wall 2. A grid 15 extends across the supply opening 12 and supports a filter 16 which is in the form of a sheet of filter cloth which is held taut over the whole of the air supply opening 12 and is clamped at its side and ends to the walls of the duct 11 so that all of the air supplied to the duct 11 flows from the duct downwardly through the filter 16.

An air outlet opening 17 which is fitted with louvres 18 is provided in the middle of the bottom of the end wall 1 and is connected by a duct 19 to a washing unit 20 and thence to an extraction fan 21.

The air supply fan 9 draws air in through an intake 22 which is controlled by a pivoted flap 23.

The air supply and extraction fans 9 and 21 together with the wash unit 20 and the flap 23 are all conventionally arranged and are not therefore described in detail. However, when spray painting is taking place in the booth 1, the flap 23 is in the position shown in FIG. 1 so that fresh air is drawn from the atmosphere through the intake 22 and is discharged through the filter 16 into the booth and this air, after it has become contaminated with droplets of paint during the paint spraying operation, is sucked out through the air outlet 17 and through the washing unit 20 by which the paint droplets are washed out of it and the washed air is discharged by the fan 21 through outlet trunking 24.

Figure 2:
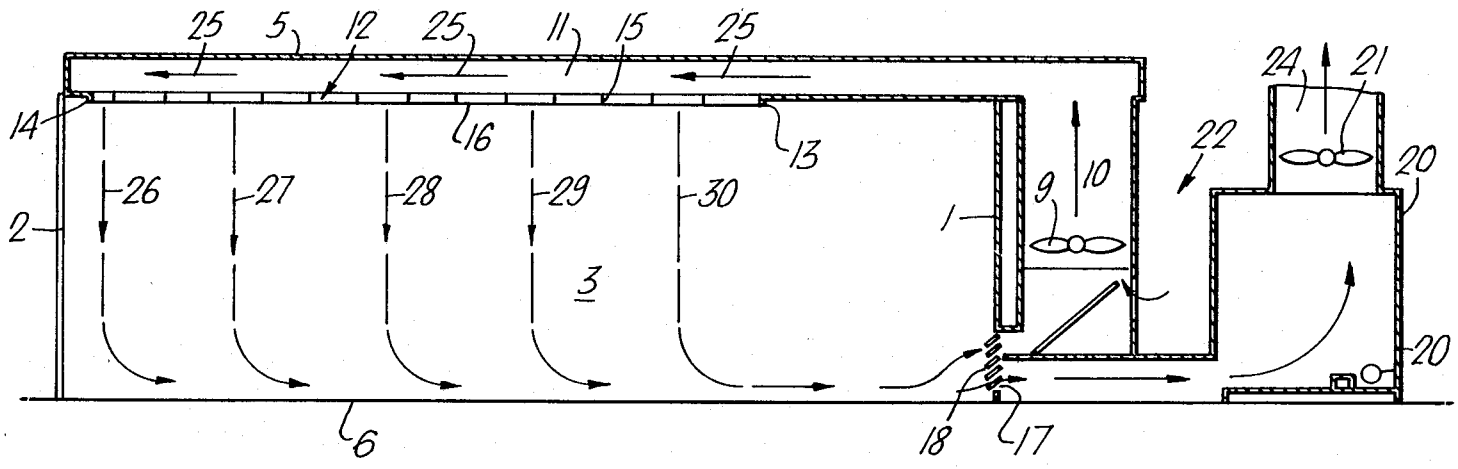
FIG. 2 is a view similar to FIG. 1, but showing a recirculatory air flow which takes place after spray painting has finished and while the paint is being dried.
Figure 3:
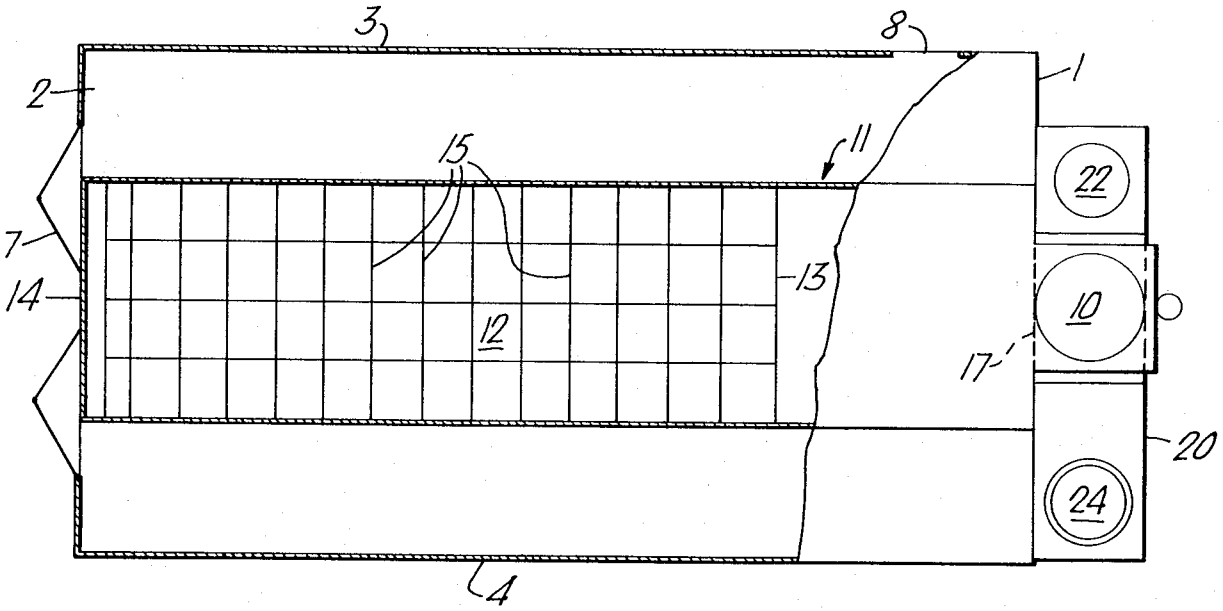
FIG. 3 is a plan view of the first example.

When painting is completed, the flap 23 is moved into the position shown in FIG. 2 of the drawings in which the fan 9 draws 95% of its intake from the outlet opening 17 and recirculates this air, which is no longer contaminated with paint droplets, through the heater 10, the duct 11 and the filter 16.

5% of the intake of the fan 9 is fresh air drawn through the intake 22 and 5% of the air supplied to the booth through the filter 16 is not recirculated to the fan 9, but passes through the outlet opening 17 to the washing unit 20 and the fan 21, which during this cycle of operation is not driven, and is then discharged to atmosphere through the trunking 24.

In this example, in the mode of operation shown in FIG. 1, the air flow through the duct 11 is approximately 350 $m^3$/min. There is of course a similar air flow outwards through the trunking 24. The air flows through the duct 11 in the direction of the arrows 25 and thence flows from the filter 16 directly downwards in the direction of the arrows 26–30. Adjacent the floor 6, the air flow from the filter 16 is diverted horizontally and the air then flows out through the air outlet opening 17.

The velocity of the air flow through the duct 11 decreases from the position of the end wall 1 towards the position of the end wall 2 and accordingly its velocity head downwards through the filter 16 increases in the same direction. The velocity head decreases as the air enters the booth through the filter 16 and accordingly the pressure head of the air immediately below the filter 16 increases from the end 13 of the filter towards the end 14 of the filter. Rather surprisingly it is found that although there is only a single air outlet opening in the end wall 1, the negative pressure adjacent the floor 6 when the extraction fan 21 is in operation decreases from the outlet opening 17 substantially uniformly towards the end wall 2. That is to say the negative pressure adjacent the floor of the booth approaches atmospheric from a position adjacent the outlet opening 17 towards the end wall. In consequence the pressure difference of the air in the booth at the positions of each of the arrows 26–30 is approximately constant and in consequence the velocity of air flow downwards along each of the arrows 26–30 is also substantially constant.

In one series of pressure tests and air flow speed tests in the illustrated example, the air pressure at the top of the arrow 26 was plus 1.5 mm water gauge and the bottom minus 0.25 mm water gauge. The downward air flow velocity along the arrow 26 was 30 m/min. The corresponding values along the arrow 27 were plus 1.25 mm water gauge, minus 0.5 mm water gauge and 29 m/min; at the arrow 28, plus 1.0 mm water gauge, minus 0.75 mm water gauge and 28 m/min; at the arrow 29, plus 0.75 mm water gauge, minus 1.0 mm water gauge and 27 m/min; at the arrow 30, plus 0.5 mm water gauge, minus 1.25 mm water gauge and 26 m/min. The pressure at the air outlet opening 17 was minus 3 mm water gauge.

In the mode of operation shown in FIG. 2, in which the air is being recirculated, the air flow pattern was found to be broadly similar to that in the mode of operation shown in FIG. 2, but owing to the reduced size of the inlet to the air supply fan 9, and due to the inactivity of the fan 21, the total air flow is reduced by approximately one third. The bleed of fresh air into the intake 22 of the air supply fan 9 during recirculation is effected to prevent an excessive build-up of solvent from the paint being dried in the recirculated air stream. Of course, though, the pattern of air flow through the booth during the drying cycle is by no means as critical as that while painting is taking place because the air no longer carries droplets of paint which can be precipitated in air eddies or areas of turbulence within the booth.

In the example shown in FIGS. 1 to 4, the air supply duct 11 has a width of 2 m and a height of 0.3 m. The air outlet opening 17 has width of 1.1 m and a height of 0.25 m.

Figure 7:
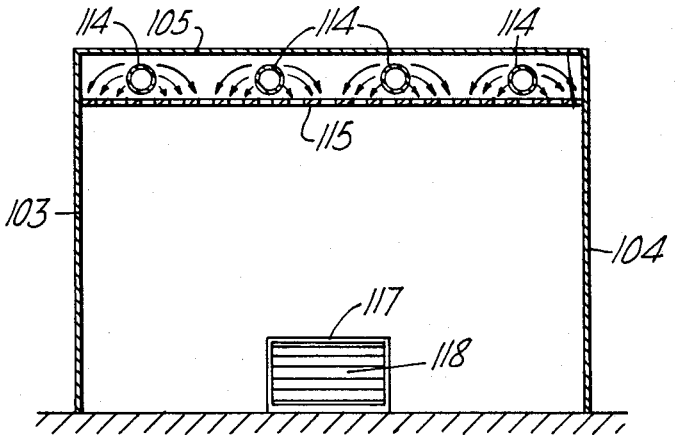
Figure 5:
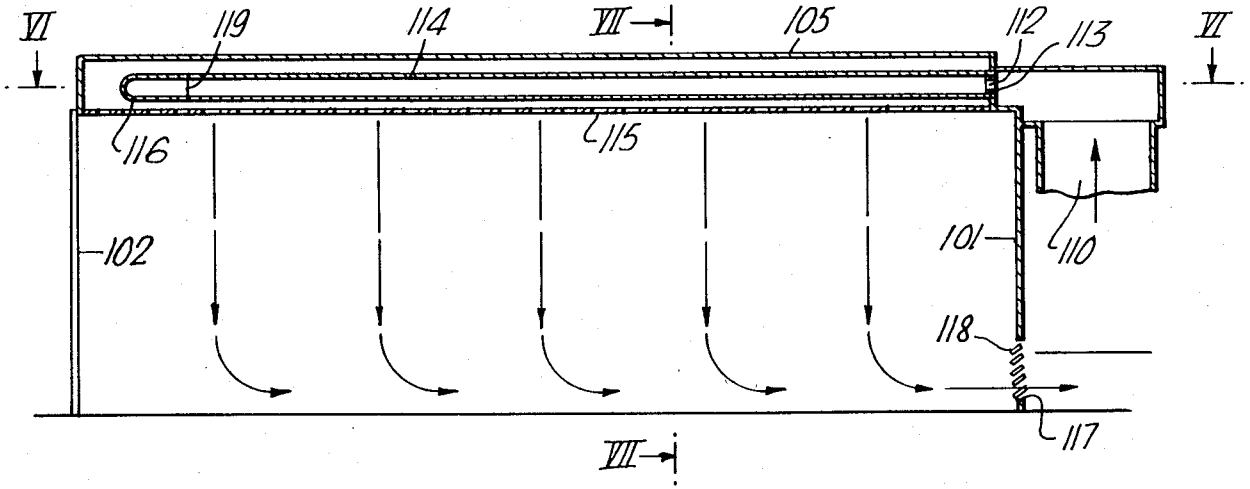
FIG. 5 is a longitudinal sectional view corresponding to FIG. 1, but of a second example.
Figure 6:
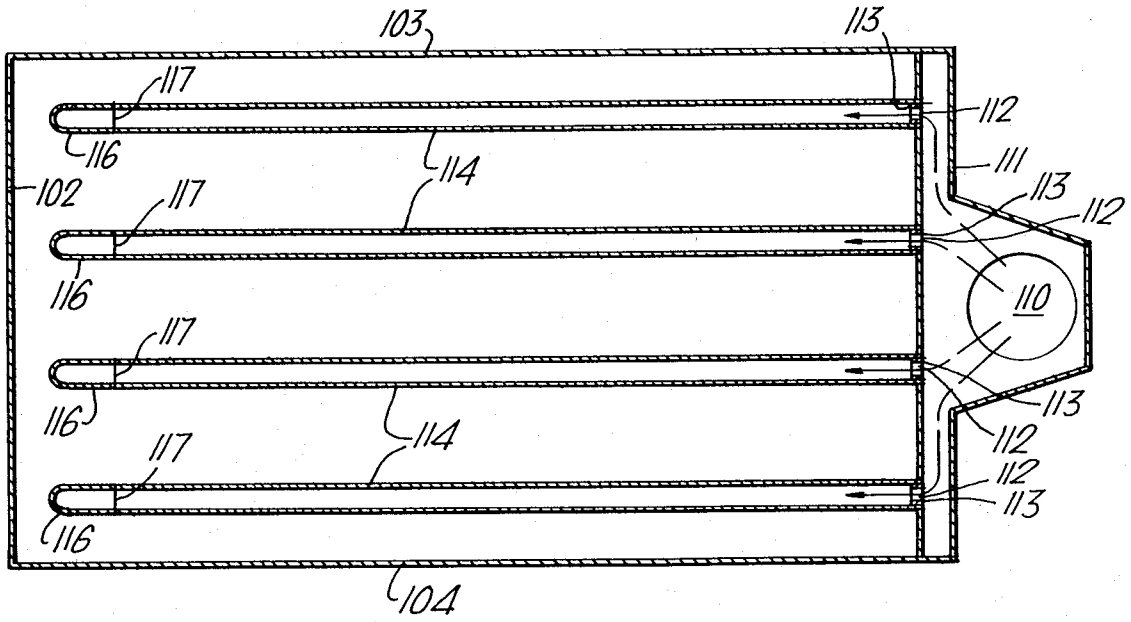
FIG. 6 is a sectional plan view of the second example on the line VI—VI in FIG. 5; and, FIG. 7 is a cross-section through the second example as seen in the direction of the arrows on the line VII—VII in FIG. 5.

The second example of the spraybooth, which is illustrated in FIGS. 5 to 7 of the drawings is generally similar to the first example and has at one end 101 an air supply fan, an air extraction fan and a water washing unit which are not shown. At its other end 102, it has doors, which are similar to the doors 7 of the first example, but which are also not shown.

The air supply fan leads to a heater 110, which is similar to the heater 10 of the first example, but in place of the duct 11 of the first example, there is an air supply manifold 111 situated at one end of the top 105. The manifold 111 has four circular air outlet openings 112 each of which is surrounded by a tubular spigot 113. Four tubes 114, which are made of filter cloth and form filter bags, each have one end clamped around and sealed to one of the spigots 113.

The four filter tubes 114 extend from the manifold 111 almost up to the end wall 102. They are held in position immediately below the top 105 from a sheet of metal mesh or expanded metal 115 which extends across the booth and is fixed to the side walls 103 and 104. Each of the tubes 114 has a detachable end closure portion 116 which is detachably fixed to the remainder of the tube by a joining ring 119.

Air is supplied to the manifold 111 by the air supply fan through the heater 110 and it then flows through the openings 112 into the filter tubes 114. The air passes through the walls of the filter tubes 114, but is constrained by the presence of the top 105 and the upper parts of the side walls 103 and 104 to flow downwards through the metal mesh or expanded metal 115.

In exactly the same way as in the first example, the velocity of flow of the air through the tubes 114 decreases from the manifold 111 up to the closed ends of the tubes adjacent the end wall 102. In consequence the air pressure in the tubes 114 increases from the manifold towards the end wall 102 and the downward air flow per unit length of the tubes 114 increases from the end 101 towards the end 102 of the booth in exactly the same way as in the first example.

The second example has an air outlet opening 117 fitted with louvres 118 and this opening is connected by a duct to an air extraction fan in exactly the same way as in the first example. Accordingly the air flow pattern in the second example is very similar to that in the first example and takes place in the manner indicated by the arrows 126 to 130. The velocities of flow along the arrow 126 to 130 are substantially the same as each other.

The advantage of the second example is that cleaning of the filter tubes 114 at their ends adjacent the end wall 102 is considerably easier than cleaning of the filter 16 adjacent the end wall 2 in the first example. Owing to the greater air flow through both the filter 16 and the filter tubes 114 adjacent the end walls 2 and 102, there is a tendency for the amount of dust deposited in these parts of the filter to be much greater than that on the parts of the filter 16 or the tubes 114 adjacent the end wall 101. The accumulation of dust decreases the air flow through the filter adjacent the end wall 2 or 102 which is at the position where it is required to be greatest. It is difficult to clean the flat horizontal sheet of filter material 16 extending over the flat opening 12 in the first example, but in the second example, cleaning of the ends of the tubes 114 is made easy by removal of the detachable portions 116.

I claim:

1. In a spraybooth for use in spray painting motor vehicles, said spraybooth including first and second side walls, first and second end walls, a top, vehicle access doors and means mounting said access doors in said second end wall, the improvement comprising an air supply and extraction system comprising air supply duct means which extends substantially centrally along the length of said top and is spaced from said first and second side walls, means defining at least one air supply opening in said air supply duct means, and filter means fitted to said at least one opening for suplying air downwardly, said filter means extending from a position at or adjacent said first end wall to a position at or adjacent said second end wall, means defining at least one air outlet opening only in the bottom of said first end wall, air extraction means connected to said at least one air outlet opening for extracting air from said spraybooth through said at least one outlet opening, blower means for causing air to flow through said air supply duct means only in a direction from said first end wall towards said second end wall of said spraybooth, and air heater means for heating said air caused to flow through said air supply duct means, whereby, in operation, the velocity head of the air flowing through said air supply duct means decreases and the pressure head of said air flowing through said duct means increases along the whole length of said filter means in a direction from said first end wall towards said second end wall, and the downward air flow from said filter means per unit length of said air supply duct means increases in a direction from said first end wall towards said second end wall of said booth, such that an extremely efficient downward air flow pattern in the spraybooth is achieved with little or no turbulence, whereby, after spraying, droplets of paint with which the air in the spraybooth is contaminated after spraying are not precipitated on the surface of the motor vehicle which has been sprayed.

2. A spraybooth as claimed in claim 1, in which said filter means extends along said booth right up to said second end wall remote from said first end wall in which said at least one air outlet opening is provided.

3. A spraybooth as claimed in claim 1, in which said filter means terminates at a distance of not more than 20% of the length of said spraybooth from said first end wall.

4. A spraybooth as claimed in claim 1, in which, in cross section, said air supply duct means has a height equal to not more than one quarter of the width thereof and there is a single air supply opening which extends across substantially the whole of the width of said underside of said air supply duct means.

5. A spraybooth as claimed in claim 1, in which there is only a single air outlet opening and said single air outlet opening is in the middle of the bottom of said first end wall.

6. A spraybooth as claimed in claim 5, in which said outlet opening has a width equal to substantially one quarter of the width of said spraybooth between said first and second side walls and said outlet opening has a height equal to substantially one quarter of the width of said outlet opening.

7. A spraybooth as claimed in claim 1, further comprising louvre means in said at least one air outlet opening, said louvre means being downwardly inclined in a direction towards the inside of said booth.

8. A spraybooth as claimed in claim 4, in which said filter means comprises a panel of filter cloth extending tautly over the whole extent of said air supply opening.

9. A spraybooth as claimed in claim 1, in which said at least one air outlet opening has a minimum distance from said first side wall and said second side wall of not less than 5% of the distance between said first side wall and said second side wall.

10. A spraybooth as claimed in claim 1, in which said air supply duct means includes a straight length of ducting directed longitudinally of said spraybooth upstream of the end of said at least one air supply opening adjacent said first end wall, said straight length of ducting being interposed between said at least one opening and said blower means.

11. A spraybooth as claimed in claim 10, in which said blower means is situated outside said first end wall of said spraybooth and further comprising upwardly extending duct means connecting said blower means to said straight length of ducting.

12. A spraybooth as claimed in claim 11, wherein an air heater means is mounted in said upwardly extending duct means.

* * * * *